US011691775B2

(12) United States Patent
Garthaffner et al.

(10) Patent No.: US 11,691,775 B2
(45) Date of Patent: Jul. 4, 2023

(54) METHOD AND APPARATUS FOR PRODUCING POUCHED TOBACCO PRODUCT

(71) Applicant: Philip Morris USA Inc., Richmond, VA (US)

(72) Inventors: Martin T. Garthaffner, Richmond, VA (US); Barry S. Smith, Richmond, VA (US)

(73) Assignee: Philip Morris USA Inc., Richmond, VA (US)

( * ) Notice: Subject to any disclaimer, the term of this patent is extended or adjusted under 35 U.S.C. 154(b) by 0 days.

(21) Appl. No.: 17/831,640

(22) Filed: Jun. 3, 2022

(65) Prior Publication Data

US 2022/0297868 A1 Sep. 22, 2022

Related U.S. Application Data

(60) Continuation of application No. 17/034,463, filed on Sep. 28, 2020, now Pat. No. 11,383,873, which is a (Continued)

(51) Int. Cl.
*B65B 9/00* (2006.01)
*B65B 61/24* (2006.01)

(Continued)

(52) U.S. Cl.
CPC ..... *B65B 61/24* (2013.01); *B65B 9/2028* (2013.01); *B65B 9/213* (2013.01); *B65B 37/08* (2013.01);

(Continued)

(58) Field of Classification Search
CPC ..... B65B 29/00; B65B 61/24; B65B 63/02; B30B 11/16

(Continued)

(56) References Cited

U.S. PATENT DOCUMENTS 2,372,406 A * 3/1945 Treneer ..... B65D 75/30 241/3
2,478,505 A * 8/1949 Salfisberg ..... B29C 66/849 53/526

(Continued)

FOREIGN PATENT DOCUMENTS

DE 2109834 A1 9/1972
JP H04-228056 A 8/1992

(Continued)

OTHER PUBLICATIONS

English translation of Russian Office Action dated Dec. 5, 2014, of Russian Application No. 2012132451/13.

(Continued)

*Primary Examiner* — Eyamindae C Jallow
(74) *Attorney, Agent, or Firm* — Harness, Dickey & Pierce, P.L.C.

(57) ABSTRACT

In a method and apparatus for producing a small pouch with a predetermined amount of particulate material therein, a predetermined amount of the particulate material is portioned from a bulk supply and compacted into a single discrete caplet. The caplet is the deposited into an open hollow pouch closed at one end thereof, and the open end is then closed with the caplet between the closed ends of the pouch. The caplet in the pouch is then compressed to return it to its particulate form. The particulate material may be granular or shredded tobacco.

20 Claims, 1 Drawing Sheet

Related U.S. Application Data continuation of application No. 15/967,222, filed on Apr. 30, 2018, now Pat. No. 10,807,753, which is a division of application No. 12/979,426, filed on Dec. 28, 2010, now Pat. No. 9,957,075.

(60) Provisional application No. 61/291,119, filed on Dec. 30, 2009.

(51) Int. Cl.

| | |
|---|---|
| ***B65B 9/20*** | (2012.01) |
| ***B65B 9/213*** | (2012.01) |
| ***B65B 37/08*** | (2006.01) |
| ***B65B 61/20*** | (2006.01) |
| *B65B 51/16* | (2006.01) |
| *B65B 51/26* | (2006.01) |
| *B65B 63/02* | (2006.01) |

(52) U.S. Cl.
CPC ..... *B65B 61/20* (2013.01); *B65B 51/16* (2013.01); *B65B 51/26* (2013.01); *B65B 63/026* (2013.01)

(58) Field of Classification Search
USPC ..... 53/121, 436, 438, 526, 529
See application file for complete search history.

(56) References Cited

U.S. PATENT DOCUMENTS

| | | | | |
|---|---|---|---|---|
| 2,987,987 | A * | 6/1961 | Raney | B30B 11/16 100/98 R |
| 3,450,529 | A * | 6/1969 | MacDonald | B30B 11/006 419/48 |
| 3,517,480 | A | 6/1970 | Pinkham | |
| 3,603,058 | A | 9/1971 | Schubert | |
| 3,734,659 | A * | 5/1973 | Harris | B30B 11/006 425/367 |
| 3,824,054 | A * | 7/1974 | Harris | B30B 11/16 425/149 |
| 3,833,327 | A | 9/1974 | Pitzer et al. | |
| 3,901,635 | A | 8/1975 | Greenberger | |
| 5,174,088 | A | 12/1992 | Focke et al. | |
| 5,286,321 | A * | 2/1994 | Fuss | B29B 17/0026 156/499 |
| 6,254,911 | B1 * | 7/2001 | Komatsu | B29C 65/18 53/436 |
| 6,402,496 | B2 | 6/2002 | Ishikawa et al. | |
| 7,032,601 | B2 | 4/2006 | Atchley et al. | |
| 7,247,013 | B2 * | 7/2007 | Roland | B30B 11/18 425/363 |
| 8,122,893 | B2 * | 2/2012 | Boldrini | B65B 9/213 53/202 |
| 10,308,379 | B2 | 6/2019 | Bierschenk et al. | |
| 10,308,385 | B2 | 6/2019 | Bierschenk et al. | |
| 2002/0119874 | A1 | 8/2002 | Heitmann et al. | |
| 2007/0261707 | A1 | 11/2007 | Winterson et al. | |
| 2008/0202532 | A1 * | 8/2008 | Wygal | B65B 63/02 131/111 |
| 2010/0071711 | A1 * | 3/2010 | Boldrini | B65B 61/08 131/112 |
| 2010/0101189 | A1 * | 4/2010 | Boldrini | B65B 51/306 53/552 |
| 2010/0252056 | A1 | 10/2010 | Gruss et al. | |
| 2011/0303232 | A1 | 12/2011 | Williams | |

FOREIGN PATENT DOCUMENTS

| | | | |
|---|---|---|---|
| JP | 2000-281141 | A | 10/2000 |
| RU | 2289999 | C1 | 12/2006 |
| RU | 2294675 | C2 | 3/2007 |
| WO | WO-2008114122 | A2 | 9/2008 |

OTHER PUBLICATIONS

Packaging Machine MP-2; Machine Design & Electro-Mechanical Engineering; www.nastecgmi.com/MP2.pdf (Author Unknown).
International Search Report and Written Opinion of International Application No. PCT/IB2010/003473 dated Sep. 14, 2011.
International Preliminary Report on Patentability for PCT/IB2010/003473 dated Jul. 4, 2012.

* cited by examiner

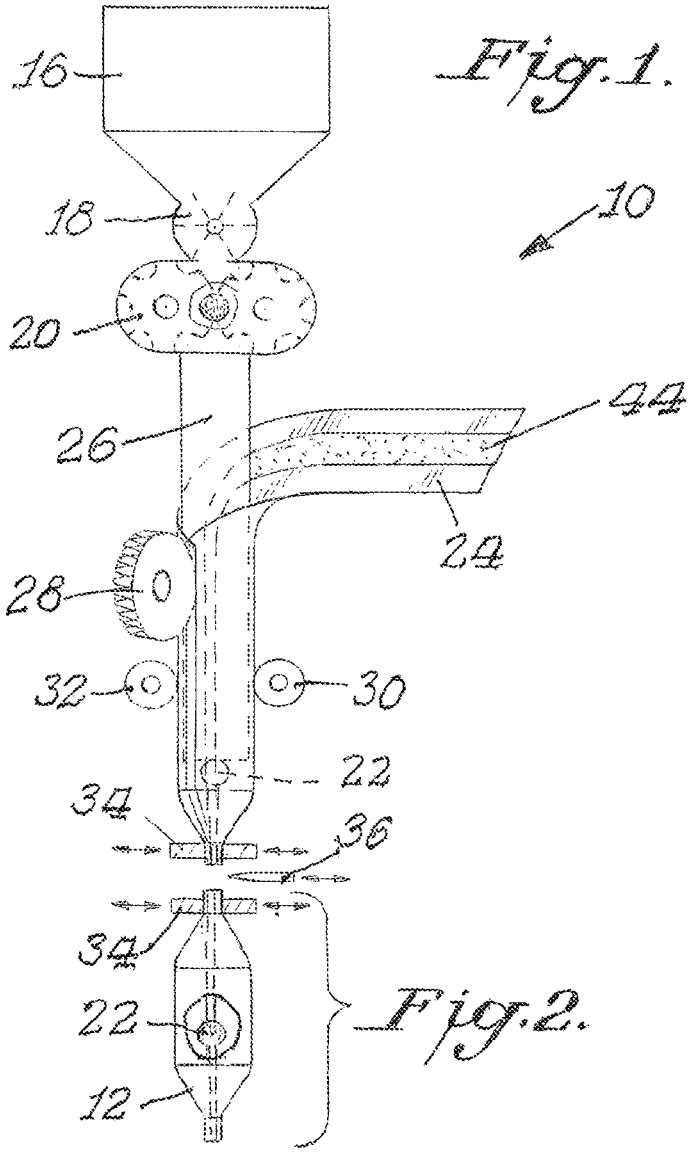
Fig. 1.
Fig. 2.
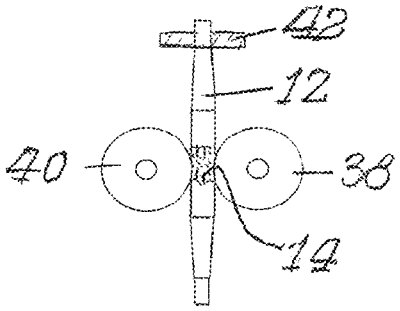
Fig. 3.

METHOD AND APPARATUS FOR PRODUCING POUCHED TOBACCO PRODUCT

CROSS-REFERENCE TO RELATED APPLICATIONS

This application is a continuation of U.S. patent application Ser. No. 17/034,463, filed Sep. 28, 2020, which is a continuation of U.S. patent application Ser. No. 15/967,222, filed Apr. 30, 2018, which is a divisional of U.S. patent application Ser. No. 12/979,426, filed Dec. 28, 2010, which claims the benefit of U.S. Provisional Application No. 61/291,119 filed Dec. 30, 2009, the entire contents of each of which are hereby incorporated by reference.

BACKGROUND OF THE INVENTION

The present invention relates to the production of a small pouch, and more particularly to a pouch with a precise amount of particulate material within the pouch.

Smokeless tobacco is often sold in small pouches designed for placement in the mouth of the user. In many instances granular or shredded tobacco is placed within an open pouch while the tobacco is in its particulate form, and this can lead to undesirable scattering of the particulate during handling and deposit into the pouch. Also, under high production speeds it is also difficult to deposit precise amounts of particulate material over long production runs. This causes inconsistency in the final product.

SUMMARY OF THE INVENTION

Accordingly, one of the objects of the present invention is the production of a small pouch with a precise amount of particulate material in the pouch.

Another object of the present invention is a procedure that is easy to follow and that consistently produces a small pouch with a precise amount of particulate material in the pouch.

Still another object of the present invention is an apparatus that functions in a highly efficient manner to produce small pouches, each with a precise amount of particulate material therein.

In accordance with the present invention, a method is provided for producing a small pouch with a predetermined amount of particulate material within the pouch. The various method steps include portioning a predetermined amount of particulate material from a bulk supply of such material, and compacting the predetermined amount of particulate material into a single discrete caplet. The caplet is then deposited into an open hollow pouch closed at one end thereof, and the pouch is later closed at the open end thereof with the caplet between the closed ends of the pouch. The discrete caplet is subsequently compressed in the pouch to return the caplet to a predetermined amount of particulate material.

The method may also include the step of placing a flavor strip in the pouch, and in a preferred embodiment, the pouch is formed from an endless strip of flexible material. The particulate material may be granular or shredded tobacco.

The present invention also includes apparatus for producing a small pouch with a predetermined amount of particulate material within the pouch. A bulk supply of particulate material is provided, and a portioning device receives a predetermined amount of particulate material from the bulk supply. A compressor then forms the predetermined amount of particulate material into a single discrete caplet, and a feeding device deposits the caplet into an open hollow pouch closed at one end thereof. A sealing device closes the pouch at the open upper end, and subsequently, a compressor engages the discrete caplet to return the caplet to its particulate form.

BRIEF DESCRIPTION OF THE DRAWINGS

Novel features and advantages of the present invention in addition to those noted above will be become apparent to persons of ordinary skill in the art from a reading of the following detailed description in conjunction with the accompanying drawings, wherein similar reference characters refer to similar parts and in which:

FIG. 1 is a diagrammatic elevational view illustrating formation of a small pouch and the formation and deposit of a discrete caplet into the pouch, according to the present invention;

FIG. 2 is a diagrammatic elevational view illustrating closure of the upper end of the pouch after deposit of the caplet therein; and FIG. 3 is a further diagrammatic elevational view illustrating compression of the caplet to return the caplet to its particulate form.

DETAILED DESCRIPTION OF THE INVENTION

Referring in more particularity to the drawings, FIG. 1 illustrates an apparatus 10 for producing a small pouch 12 with a predetermined amount of particulate material 14 within the pouch. The apparatus may be used to produce smokeless tobacco products often sold in small pouches specifically designed for placement in the mouth of the user. In such cases the particulate material 14 may be shredded or granular tobacco.

The apparatus 10 includes a hopper 16 for holding a bulk supply of the particulate material 14. A portioning device 18 in the form of a meter receives a predetermined amount of particulate material 14 from the hopper 16, and a roll compactor 20 functions to compress the predetermined amount of particulate material 14 into a single discrete caplet 22.

The pouch 12 is formed from an endless web of flexible material 24 by wrapping that material around a hollow cylinder such as feed tube 26. The longitudinal edges of the web 24 are sealed together by a knurled sealing roller 28, and the pouch in its tubular form is delivered in a downstream direction by a pair of drive rollers 30, 32.

After formation of the discrete caplet 22 by the compactor 20, the caplet is deposited at a downstream location via the feed tube 26.

The tubular form of the web 24 is formed into a pouch by a sealing mechanism 34, which functions to close the lower end of the tube, as shown in FIG. 1. The formed tube is then cut by a reciprocating knife blade 36 at the closed end thereof. After such closure, the sealing mechanism moves away in an outward direction as illustrated by the arrows, and the web in its tubular form is driven in a downstream direction by the rollers 30, 32. The sealing mechanism 34 then engages the upper end of the pouch, whereby both ends of the pouch are closed with the caplet 22 therein.

The next phase of the operation is shown in FIG. 3, where compression rollers 38, 40 engage and compress the caplet to return it to its particulate form. This may be done by holding the upper end of the pouch 12 with a clamp 42, and moving the compression rollers 38, 40 in an upward or downward direction to pulverize the caplet and return it to its particulate form.

A flavor strip 44 may be included in each pouch 12 to impart a desired flavor to the granular of shredded tobacco 14 within the pouch. In this regard, an endless flavor strip may be provided on the web 24 of the pouch material so that subsequent cutting by knife blade 36 also cuts the flavor strip into a piece within each pouch.

The preferred embodiment may be practiced with poucher machines such as those manufactured by Merz Verpackungsmaschinen GmbH, Lich, Germany.

What is claimed is:

1. A method of making a pouch product, the method comprising:

engaging a discrete caplet with a roller, the discrete caplet in a pouch; and forming the pouch product by translating the roller with respect to the discrete caplet to compress the discrete caplet into a particulate material, the particulate material in the pouch.

2. The method of claim 1, wherein the engaging includes arranging the discrete caplet between a pair of compression rollers, the pair of compression rollers including the roller.

3. The method of claim 1, further comprising:

retaining the pouch during the translating.

4. The method of claim 3, wherein the retaining includes engaging the pouch with a clamp.

5. The method of claim 1, wherein the forming includes translating the roller in an upward direction or a downward direction.

6. The method of claim 1, further comprising:

enclosing the discrete caplet in the pouch prior to the engaging.

7. The method of claim 6, further comprising:

depositing the discrete caplet into the pouch prior to the enclosing.

8. The method of claim 7, wherein the depositing includes gravity depositing the discrete caplet into the pouch.

9. The method of claim 6, further comprising:

compacting the particulate material into the discrete caplet prior to the enclosing.

10. The method of claim 9, wherein the compacting includes roll compacting.

11. The method of claim 9, further comprising:

portioning the particulate material from a bulk supply prior to the compacting.

12. The method of claim 6, further comprising:

placing a flavor strip in the pouch prior to the enclosing.

13. The method of claim 6, further comprising:

forming the pouch from a web of flexible material prior to the enclosing.

14. The method of claim 13, wherein the forming includes wrapping the web of flexible material around a hollow cylinder.

15. The method of claim 14, further comprising:

depositing the discrete caplet through the hollow cylinder and into the pouch prior to the enclosing.

16. The method of claim 13, wherein the forming further includes sealing a longitudinal edge of the web of flexible material.

17. The method of claim 16, wherein the sealing includes engaging the flexible material with a knurled sealing roller.

18. The method of claim 13, wherein the forming further includes cutting the pouch from the web of flexible material.

19. The method of claim 18, wherein the cutting includes engaging the flexible material with a reciprocating knife blade.

20. The method of claim 1, wherein the particulate material includes tobacco.

* * * * *